US008056460B2

(12) United States Patent
Herring

(10) Patent No.: US 8,056,460 B2
(45) Date of Patent: Nov. 15, 2011

(54) BOLT CARRIER FOR GAS-OPERATED FIREARMS

(76) Inventor: Geoffrey A. Herring, Blacksburg, VA (US)

( * ) Notice: Subject to any disclaimer, the term of this patent is extended or adjusted under 35 U.S.C. 154(b) by 0 days.

(21) Appl. No.: 12/804,145

(22) Filed: Jul. 14, 2010

(65) Prior Publication Data

US 2011/0030260 A1 Feb. 10, 2011

Related U.S. Application Data

(62) Division of application No. 11/700,319, filed on Jan. 30, 2007, now Pat. No. 7,779,743.

(60) Provisional application No. 60/763,405, filed on Jan. 30, 2006.

(51) Int. Cl.
*F41A 5/18* (2006.01)

(52) U.S. Cl. ..... 89/1.4; 89/191.01

(58) Field of Classification Search ..... 89/1.4, 89/1.42, 191.01
See application file for complete search history.

(56) References Cited

U.S. PATENT DOCUMENTS 2,590,153 A * 3/1952 Bunnell ..... 89/1.4
3,651,736 A * 3/1972 Ingram ..... 89/132
2005/0223613 A1* 10/2005 Bender ..... 42/16

* cited by examiner

*Primary Examiner* — Stephen M Johnson
(74) *Attorney, Agent, or Firm* — Galasso & Assoc. L.P.; David O. Simmons

(57) ABSTRACT

A kit for modifying a bolt carrier group actuating apparatus of a firearm manufacturer-configured with a gas-driven bolt carrier comprises a gas expansion assembly, an operating rod driven bolt carrier and an operating rod. The gas expansion assembly is configured for receiving combustion gases from an as-manufactured OEM gas block of the firearm and for facilitating expansion of said gases for generating a bolt carrier driving force. The operating rod driven bolt carrier includes an operating rod engaging lug. The operating rod driven bolt carrier is configured for being operably engaged within an as-manufactured OEM receiver body of the firearm with the operating rod engaging lug located in a gas tube lug receiving portion of the as-manufactured OEM receiver body. The operating rod is engagable between the gas expansion assembly and the operating rod engaging lug.

8 Claims, 6 Drawing Sheets

BOLT CARRIER FOR GAS-OPERATED FIREARMS

CROSS REFERENCE TO RELATED APPLICATIONS

This divisional patent application claims priority from U.S. Non-provisional patent application Ser. No. 11/700,319; filed Jan. 30, 2007, now U.S. Pat. No. 7,779,743, entitled "Gas Piston Assembly And Bolt Carrier For Gas-Operated Firearms", which claims priority from U.S. Provisional Patent Application Ser. No. 60/763,405; filed Jan. 30, 2006; entitled "Gas Piston Assembly And Improved Bolt Carrier For Gas-Operated Firearms", both of which have a common applicant herewith and being incorporated herein in their entirety by reference.

FIELD OF THE DISCLOSURE

The disclosures made herein relate generally to gas operated firearms and, more particularly, to mechanism and methods for facilitating actuation of a bolt carrier in a gas-operated firearm.

BACKGROUND

Many firearms, such as assault rifles that are commonly used in military and law enforcement situations are designed by their manufacturer to be gas-operated. The AR-15 family of firearms, including the M16-type firearms, illustrates examples of assault rifles that are designed by their manufacturer to be gas-operated. M16-type firearms are a military version of the AR-15 family of firearms and are capable of operating in a fully automatic mode. M16-type firearms have been manufactured by companies including, but not limited to, Colt Manufacturing Company, the ArmaLite Division of Fairchild Aircraft and Engine Company, BushMaster Firearms Incorporated and Fabrique Nationale.

As originally designed, the AR-15, M16 and M4 firearms are collectively and generically referred to in the industry as "M16-type" weapons. M16-type weapons are auto loading and are usually either semi-automatic, full-automatic, burst-fire, selective-fire, or a combination of the above. As such, M16-type weapons are subjected to higher volumes of firing than many sporting type firearms and they are accordingly subjected to higher levels of heat, fouling and component failures.

M16-type weapons have been the primary service weapons of the US Armed Forces and many of its allies for more than forty years. M16-type weapons are usually "gas-operated" as disclosed by Stoner in U.S. Pat. No. 2,951,424. Generally, the Stoner gas-operated system has a gas block that is mounted to the barrel and a bolt carrier that is designed to reciprocate in an upper receiver. The barrel has a gas-regulating orifice known as a "gas-port" residing under the gas block. The purpose of the gas-port is to control the amount of gas delivered to the gas system from the bore, the size of which has an effect on the cyclic rate of the weapon. The bolt carrier acts as a gas cylinder and possesses a "key" mounted to its upper surface. The bolt acts as a piston and is housed within the bolt carrier. A gas tube is connected to the gas block on one end, and passes through a hole in the upper receiver to interface with the bolt carrier key, through a telescoping arrangement between the two parts. The purpose of the gas tube is to communicate gas pressure from the gas block on the barrel, to the bolt carrier and bolt arrangement. In most cases, the gas tube has an offset step on one end versus the other; i.e. the two ends do not share a common bore axis and the hole in the gas block for receiving the gas tube is not in alignment with the hole in the upper receiver for receiving the opposite end of the gas tube. Upon firing a cartridge, the projectile in the barrel passes a gas port in the barrel, and some of the hot expanding gasses that are propelling the projectile escape into the gas port. These expanding gasses and resulting pressure are in turn transmitted to the bolt carrier (cylinder) and bolt (piston) arrangement. Upon entering the cavity in the bolt carrier, the pressure forces a separation of the bolt and carrier and propels them in opposite directions. As the bolt is fixed against the breech face, the bolt carrier travels in the recoil direction. Some residual gas is vented through ports in the bolt carrier to the outside of the upper receiver. When the telescoping key leaves the end of the gas tube, remaining gasses in the gas tube are vented into the upper receiver body where the bolt carrier travels and consequently into the internal operating components of the weapon. Upon reaching full recoil, an action spring returns the bolt carrier in the counter-recoil direction toward its forward static position.

M16-type weapons have a known history of problems associated with gas-operation of its bolt carrier group. Some of these problems were disclosed in the 1967 Ichord Investigation, which sought answers to M16-type weapon failures in the combat zones in which US soldiers were fighting. In other reports, it has been revealed that the gas system of the M16 rifle is sensitive to certain ammunition propellants containing calcium carbonate as an ingredient. Carbon deposits and resulting fouling from the M16-type gas system can compromise the reliability of the weapon. This fouling makes it difficult for an operator to clean his M16-type weapon, particularly in a combat zone where opportunity to clean weapons may be difficult to encounter. Other component failures have been attributed to the heat delivered by the gas tube to the M16-type weapon's internal components, such as ejector and extractor springs. Gas tube failures occur when the weapon is subjected to high levels of firing in a short amount of time, generating excessive heat and thereby causing the thin gas tube to enter a plastic state whereby it "droops" or bursts. Still more problems and failures have been attributed to the M16-type weapon's high cyclic rate, especially in the shortened carbine variants which attempt to unlock the breech bolt under higher pressures.

In the aftermath of the Ichord Report, Colt's Patent Firearms designed the "Model 703" rifle. The Model 703 used a long-stroke, gas-piston device similar to an AK-47 that required an entirely new upper receiver assembly be fitted to M16-type lower receivers, which is an expensive proposition. While there exists little information on this system, it can be surmised from publicly available photographs that it likely suffered from increased weight, bolt carrier binding in the receiver extension tube, and manufacturing and logistical difficulties due to the number of components that were unique to this system.

There have been prior attempts to modify M16-type rifles for gas-piston operation such as the Taiwanese T65 rifle, which is a factory built weapon that utilized a piston design similar to that disclosed in the Miller U.S. Pat. No. 3,246,567. The T65 lacked the familiar bolt closure device common to most modern M16-type weapons as disclosed in Sturtevant U.S. Pat. No. 3,326,155 and was short-lived for various reasons, including unacceptable receiver wear caused by an overturning moment of the bolt carrier and maintenance difficulty.

The commercially marketed "Rhino" device disclosed in Langendorfer U.S. Pat. No. 4,244,273 sought to modify M16-type weapons by re-working the gas block to house the piston assembly. The bolt carrier key was then reinforced with a shear pin and an impact buffer was added to it in an attempt to absorb the impact loads transmitted by the operating rod. This device suffered from the same excessive receiver wear as the T65, and its "bolt on" key would shear off of the carrier when repeatedly impacted by the operating rod. Additionally, a weapon utilizing the "Rhino" device had to be removed from service and permanently converted to accept the new components, i.e., the "Rhino" device was not a "drop-in" conversion assembly. Thus, this device was deemed frail and unsuitable for military service and it failed in the marketplace.

Many other weapons are referred to as "piston-operated", which are generally either "short-stroke" or "long-stroke" pistons. Some examples of short-stroke, piston-operated weapons are the FN-FAL, Armalite AR-18, Taiwanese T65, Russian SKS, Ultimax 100 and Steyer AUG. Some examples of long-stroke, piston-operated weapons are the German STG-44, Russian AK-47, Stoner 63, Beretta AR-70 and Robinson M96. Generally, a short-stroke, piston-operated weapon has an operating rod that is separate from the bolt carrier. A piston is energized upon firing and propels the operating rod into contact with a portion of the bolt carrier to bias it in the recoil direction. The travel distance of a short-stroke piston and operating rod are usually a fraction of the overall travel distance of the bolt carrier. Generally, a long-stroke, piston-operated weapon has a piston and operating rod that is engaged with the bolt carrier. A piston is energized upon firing and propels the operating rod and bolt carrier in the recoil direction. The travel distance of a long-stroke piston and operating rod are usually equal to the overall travel distance of the bolt carrier.

Shortened carbine variants of M16-type weapons have a shorter barrel and a shorter gas tube. Accordingly, the gas-port is located nearer the chamber compared to the rifle-length variants of the M16-type weapons. Because of the gas-regulating port location in such shortened carbine variants, the gas-port is subjected to premature erosion by heat and unburned powder particles. This port erosion causes an additional increase in cyclic rate of fire by permitting higher gas levels to act upon the bolt and bolt carrier. Higher cyclic rates cause impact energy to the moving parts to increase by the square of the velocity. This can result in a higher incidence of component failures such as bolts, bolt carriers, extractors, extractor pins, cam pins and barrel extensions.

It is important for weapons used in combat and law enforcement situations to be reliable and easy to clean and maintain in the field. For example, it is desirable that M16-type combat weapons display higher safety levels of the critical components so that they will not fail in combat, and injuries to troops and/or law enforcement personnel caused by catastrophic component failures should be reduced as much as possible. It is also desirable that M16-type combat weapons be "upgraded" by unit armorers without the need for removing the weapons from military or police inventories or from combat zones.

It is desirable that solutions to inherent problems of the M16-type weapon be economical to implement. It is also desirable for such solutions to utilize as many of the host weapon's original components as possible, thereby increasing production and resulting in a minimal impact on the logistical support network of military and law enforcement communities. It is further desirable that the upgraded weapons be familiar to the personnel using them so that training costs and time are kept to a minimum.

Therefore, an approach for retrofitting an M16-type weapon in a manner that overcomes known deficiencies associated with gas-operation of its bolt carrier group would be advantageous, desirable and useful.

SUMMARY OF THE DISCLOSURE

A principal objective of the present invention is to provide improvements to semi-automatic and full-automatic weapons, which will overcome deficiencies of known guns of such type. Accordingly, what is needed is a gas-piston system and improved bolt carrier that will readily replace the troublesome and unreliable manufacturer-configured gas-driven bolt carriers on M16-type weapons. The present invention is directed toward providing such a gas-piston system and improved bolt carrier that address the problems and shortcomings of known gas-driven bolt carriers in a novel and non-obvious manner.

In one embodiment of the present invention, a kit for modifying a bolt carrier group actuating apparatus of a firearm configured by its original manufacturer to have a gas-driven bolt carrier comprises a gas expansion assembly, an operating rod driven bolt carrier and an operating rod. The gas expansion assembly is configured for receiving combustion gases from an as-manufactured OEM gas block of a firearm and for facilitating expansion of the gases for generating a bolt carrier driving force. The operating rod driven bolt carrier includes an operating rod engaging lug. The operating rod driven bolt carrier is configured for being operably engaged within an as-manufactured OEM receiver body of the firearm with the operating rod engaging lug located in a gas tube lug receiving portion of the as-manufactured OEM receiver body. The operating rod is engagable between the gas expansion assembly and the operating rod engaging lug for exerting the bolt carrier driving force on the operating rod engaging lug.

In another embodiment of the present invention, a firearm configured by its original manufacturer to have a gas-driven bolt carrier comprises an as-manufactured OEM barrel, an as-manufactured OEM gas block, a receiver assembly, a gas expansion device, a gas expansion device, a gas spigot and an operating rod. The barrel has a bore extending between opposing end portions thereof. The as-manufactured OEM gas block is coupled to a first end portion of the barrel in a manner allowing gas from within the bore to be routed through a passage of the as-manufactured OEM gas block. The receiver assembly includes an as-manufactured OEM receiver body and an operating rod driven bolt carrier operably engaged with the as-manufactured OEM receiver body. The as-manufactured OEM receiver body is coupled to a second end portion of the as-manufactured OEM barrel such that a central bore axis of the bolt carrier extends substantially coincidental with a centerline axis of the barrel bore. The operating rod engaging lug of the operating rod driven bolt carrier is located in a gas tube lug receiving portion of the as-manufactured OEM receiver body. The gas expansion device includes an expansion body and a piston. The expansion body includes an expansion body passage extending between opposing end portions thereof. The piston is slideably engaged within the expansion body passage through one of the opposing end portions for forming a gas expansion chamber within the expansion body passage between the piston and the gas spigot and such that the expansion body and the piston define respective end portions of the gas expansion device. The gas spigot includes a gas block interface portion, a gas expansion device interface portion and a gas spigot passage extending therebetween. The gas block interface portion is engaged with the as-manufactured OEM gas block such that the gas block passage is communicative with the gas spigot passage of the gas spigot. The gas expansion device interface portion is engaged with a first one of the end portions of the gas expansion device in a manner whereby the gas spigot passage is communicatively coupled to the gas expansion chamber. The operating rod is engaged between a second one of the end portions of the gas expansion device and the operating rod engaging lug for exerting the bolt carrier driving force on the operating rod engaging lug.

In another embodiment of the present invention, a method for modifying a bolt carrier group actuating apparatus of a firearm configured by its original manufacturer to have a gas-driven bolt carrier comprises a plurality of operations. Operations are performed for removing a gas-driven bolt carrier from within a manufacturer-configured bolt carrier bore of an as-manufactured OEM receiver body of the firearm and for removing a gas tube from the firearm. The operation for removing the gas tube includes detaching the gas tube from an as-manufactured OEM gas block of the firearm. An operation is performed for installing an operating rod driven bolt carrier within the manufacturer-configured bolt carrier bore of the as-manufactured OEM receiver body. An operating rod engaging lug of the operating rod driven bolt carrier is located in a gas tube lug receiving portion of the as-manufactured OEM receiver body. Operations are performed for engaging a first end portion of a gas expansion assembly with the as-manufactured OEM gas block of the firearm, for engaging a first end portion of an operating rod with a second end portion of the gas expansion assembly and for slideably engaging a second end portion of the operating rod with the as-manufactured OEM receiver body such that the second end portion of the operating rod is aligned with an engagement face of the operating rod engaging lug.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
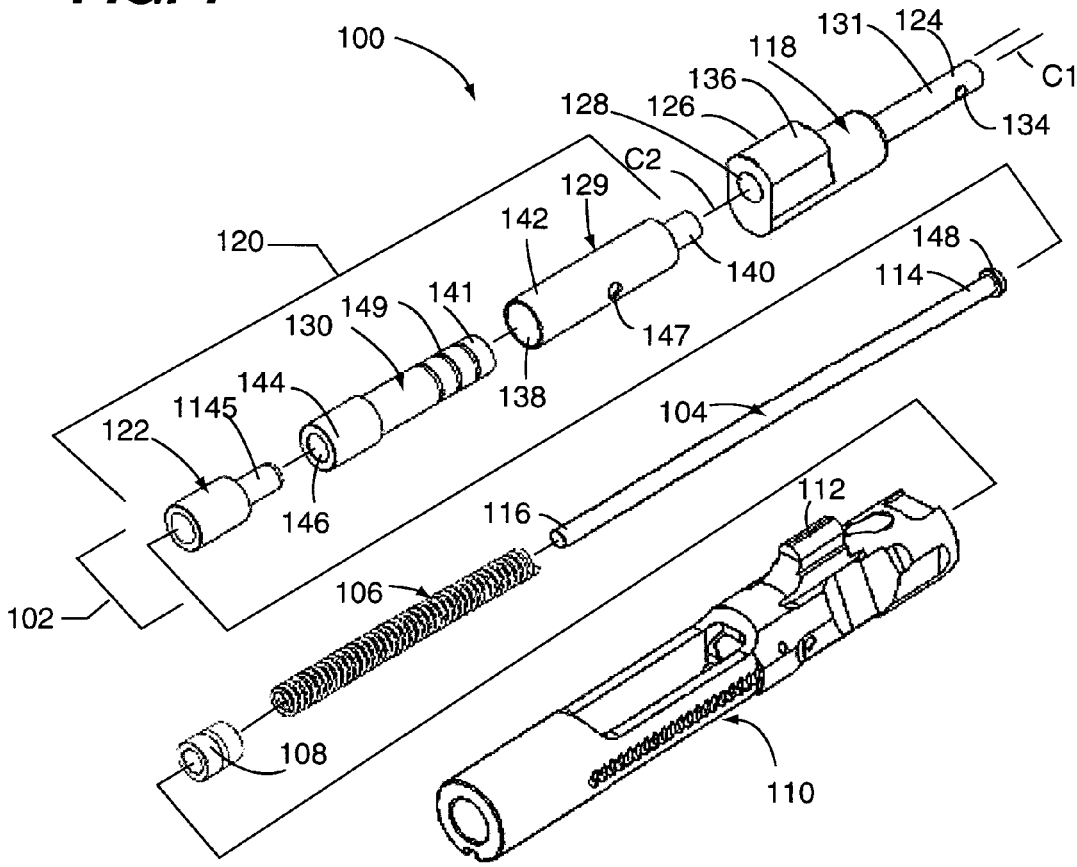
FIG. 1 is an exploded view showing an embodiment of a kit in accordance with the present invention, which is configured for modifying a bolt carrier group actuating apparatus of a firearm configured by its original manufacturer to have a gas-driven bolt carrier.

FIG. 1 shows an embodiment of a kit in accordance with an embodiment of the present invention, which is referred to herein as the kit 100. The kit 100 is configured for modifying a bolt carrier group actuating apparatus of a firearm configured by its original manufacturer to have a gas-driven bolt carrier. A principal objective of the kit 100 is to provide improvements to semi-automatic and full-automatic weapons, which will overcome deficiencies of known guns of such type. More specifically, the kit 100 allows the troublesome and unreliable manufacturer-configured gas-driven bolt carriers on certain weapons (e.g., M16-type weapons) to be replaced with a gas-piston bolt carrier group actuator system that overcomes problems and shortcomings of the known gas-driven bolt carriers in a novel and non-obvious manner. As can be seen from the disclosures made herein, a kit configured for modifying a bolt carrier group actuating apparatus in accordance with the present invention is a drop-in-kit that requires no permanent structural modifications to as-manufactured OEM (original equipment manufacturer) components of the firearm, which advantageously impacts the simplicity and cost associated with installing such a kit in a firearm.

The kit 100 includes a gas expansion assembly 102, an operating rod 104, an operating rod return spring 106, an operating rod receiver bushing 108 and an operating rod driven bolt carrier 110. The gas expansion assembly 102 is configured for receiving combustion gases from an as-manufactured OEM gas block of a firearm and for facilitating expansion of the gases for generating a bolt carrier driving force. The operating rod 104 is engagable between the gas expansion assembly 102 and an operating rod engaging lug 112 of the operating rod driven bolt carrier 110 for exerting the bolt carrier driving force on the operating rod engaging lug 112. Preferably, but not necessarily, the operating rod engaging lug 112 is a unitarily formed component such that the operating rod driven bolt carrier 110 is of a one-piece construction. Alternatively, the operating rod engaging lug 112 is a discrete component that is attached to a main body of the operating rod driven bolt carrier 110 by means such as, for example, a fastener, pocket, slot or dovetail. A first end portion 114 of the operating rod 104 is configured for engaging a mating portion of the gas expansion assembly 102 and a second end portion of the operating rod 116 is configured for engaging the operating rod engaging lug 112. The operating rod driven bolt carrier 110 is configured for being operably engaged within a bolt carrier bore of an as-manufactured OEM receiver body of the firearm with the operating rod engaging lug 112 located in a gas tube lug receiving portion of the as-manufactured OEM receiver body. As a reference, a gas tube lug receiving portion of an as-manufactured OEM receiver body is often configured as an elongated channel in which a gas tube lug of a gas-driven bolt carrier moves during translation of a gas-driven bolt carrier and the gas tube lug is often referred to in the art as a gas key.

Figure 2:
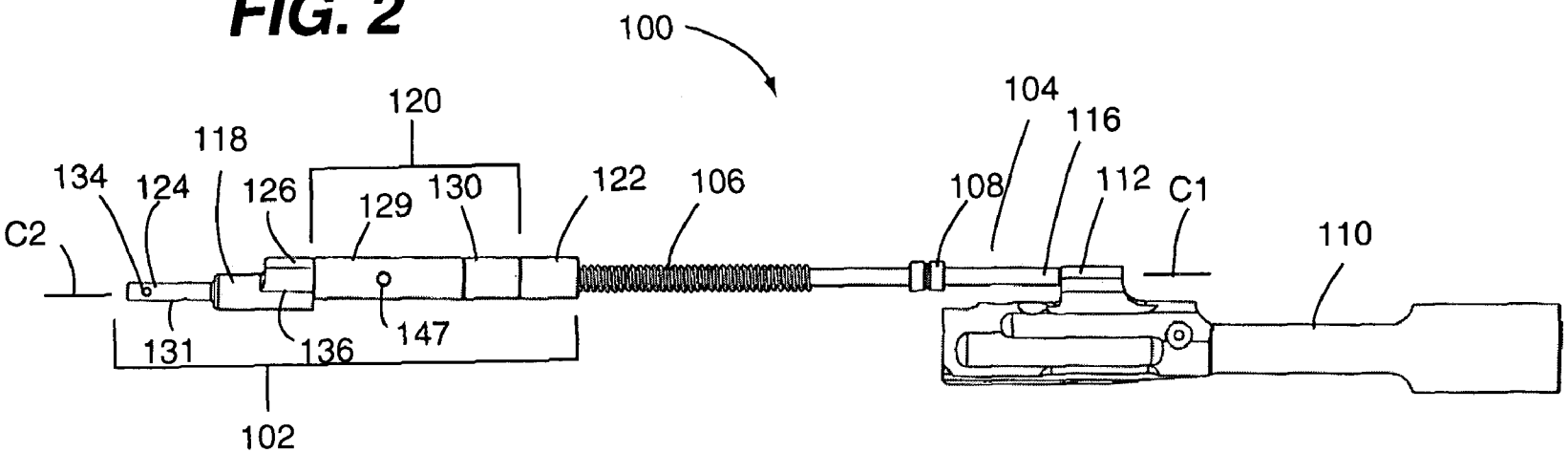
FIG. 2 is a side view showing relational positioning and relative engagement of components of the kit in FIG. 1.
Figure 3:
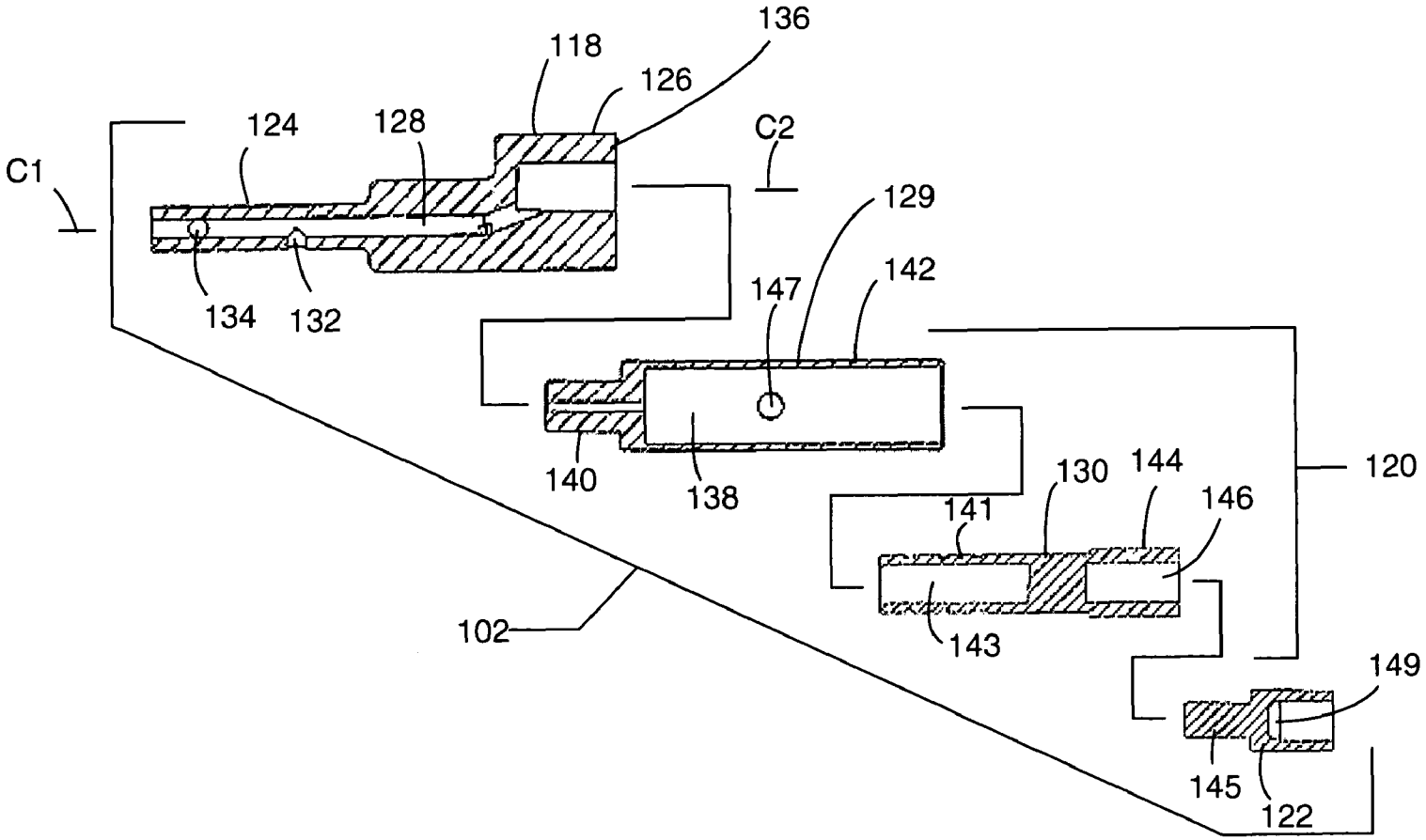
FIG. 3 is an exploded cross-sectional view showing an embodiment of a gas expansion assembly in accordance with the present invention.

Referring now to FIGS. 1-3, the gas expansion assembly 102 includes a gas spigot 118, a gas expansion device 120 and a connecting link 122. The gas spigot 118 includes a gas block interface portion 124, a gas expansion device interface portion 126 and a gas spigot passage 128 extending therebetween. The gas expansion device 120 includes an expansion body 129 and a piston 130. The expansion body 129 and the piston 130 define respective opposing end portions of the gas expansion device 120. The gas block interface portion 124 is configured for interfacing with an as-manufactured OEM gas block of the firearm for routing combustion gases from the as-manufactured OEM gas block to the gas expansion device 120. The gas expansion device 120 allows the combustion gases received from the as-manufactured OEM gas block via the gas spigot 118 to expand within the gas expansion device 120 for generating the bolt carrier driving force.

The gas block interface portion 124 includes an elongated tube 131 having the gas spigot passage 128 extending longitudinally therethrough, a gas entrance passage 132 extends between an outer surface of the elongated tube 131 and the gas spigot passage 128, and a retention device passage 134 extending radially therethrough. The gas block interface portion 124 is configured for being engaged with an as-manufactured OEM gas block of a firearm. More specifically, length and cross sectional size of the elongated tube 131 as well as placement and size of the gas entrance passage 132 and the gas spigot passage 128 are defined dependent upon allowing the elongated tube 131 to be operably engaged with an as-manufactured OEM gas block.

The gas expansion device interface portion 126 includes a mounting boss 136 having the gas spigot passage 128 extending longitudinally therethrough. Depending on the specific configuration of the gas expansion device 120 and/or chosen configuration for connecting the gas expansion device 120 to the mounting boss 136, all or a portion for the gas spigot passage 128 extending through the gas expansion device interface portion 126 may be a different size (e.g., larger than) than the gas spigot passage 128 extending through the gas block interface portion 124. For example, as shown, a portion of the gas spigot passage 128 extending through the expansion device interface portion 126 is larger than that of the gas block interface portion 124 for facilitating attachment of the gas expansion device 120 to the gas spigot 118.

As shown, a centerline axis C1 of the gas block interface portion 124 is offset with respect to a centerline axis C2 of the gas expansion device interface portion 126. Such an offset arrangement is useful in certain applications where physical clearances and/or axial alignment considerations preclude the centerline axis C1 of the gas block interface portion 124 being axially aligned (i.e., in-line) with the centerline axis C2 of the gas expansion device interface portion 126. In such applications where such an offset arrangement is not required or useful, the centerline axis C1 of the gas block interface portion 124 can be axially aligned with the centerline axis C2 of the gas expansion device interface portion 126. Specific examples of situations where the gas spigot 118 having an offset configuration is useful includes being designed for and situated to accept standard OEM hand guards such as those disclosed in U.S. Pat. No. 4,536,982, and U.S. Pat. No. 4,663,875, and to correct for the misalignment or height difference between the gas-tube receiving hole in a gas-block and the corresponding gas-tube receiving hole in the upper receiver body of a standard M16-type weapon, whereby the two described holes do not share a common longitudinal axis. Specific examples of situations where the gas spigot 118 having an in-line configuration is useful includes being designed for and situated to provide for direct alignment of the piston, cylinder, connecting link and operating rod between the gas-tube receiving hole in a gas-block and the corresponding gas-tube receiving hole in the upper receiver body, when placed in a weapon where the gas-tube receiving holes in the gas-block and upper receiver share an approximately common longitudinal axis, such as a Lewis Monolithic Rail Platform weapon described in US published patent application 20060236582A1.

With respect to the gas expansion device 120, the expansion body 129 includes a passage 138 extending between opposing end portions thereof. As shown, a first end portion 140 of the expansion body 129 is configured be being attached to the gas expansion device interface portion 126 of the gas spigot 118 and a second end portion 142 of the expansion body 129 is configured for receiving the piston 130. The first end portion 140 has external dimensions that allow it to be engaged within the gas spigot passage 128 extending through the mounting boss 136 of the gas spigot 118. Examples of approaches for engaging the first end portion 140 of the expansion body 129 with the gas expansion device interface portion 126 of the gas spigot 118 include, but are mot limited to threaded engagement, interference press fit, welding, mechanical fasteners and the like. It is disclosed herein that, in some embodiments, the gas spigot 118 and the expansion body 129 can be formed as a unitary (i.e., one-piece) component as opposed to being formed as discrete components that are attached to each other. The portion of the expansion body passage 138 within the second end portion 142 and a first end portion 141 of the piston 130 are jointly configured (e.g., being jointly dimensioned) for allowing the piston 130 to be slideably engaged within the expansion body passage 138, thereby forming a gas expansion chamber within the expansion body passage 138 between the piston 130 and gas spigot 118. In this manner, the gas spigot passage 128 is communicatively coupled to the gas expansion chamber for allowing combustion gas to be received and expanded therein for generating the bolt carrier driving force.

It is disclosed herein that gas flow regulation can be provided at any number of locations upstream of the gas expansion chamber. In one embodiment, gas entrance passage 132 of the spigot 118 serves as a gas flow-regulating orifice that regulates the amount of combustion gas entering the gas spigot 128. In another embodiment, a discrete manually adjustable gas flow regulating orifice device may be provided for allowing gas flow regulation to be manually adjusted. In still another embodiment, a portion of the expansion body passage 138 serves as a gas flow-regulating orifice. The present invention is not unnecessarily limited to a particular gas flow regulating orifice configuration.

A cavity 143 in the first end portion 141 of the piston 130 may be provided for reducing weight of the piston 130, and which also defines a portion of the a gas expansion chamber. The piston 130 can include one or more grooves 149 (i.e., sometimes referred to a gas grooves or obturation grooves), which serve the functions of providing a piston-expansion body seal and providing for self-cleaning of contaminant build-up at the piston-expansion body interface. A second end portion 144 of the piston 130 is configured (e.g., via overall dimension) for engaging the expansion body 129, thereby defining a maximum insertion depth of the first end portion 141 of the piston 130 within the mating portion of the expansion body passage 138. As shown, the expansion body 129 includes a gas vent hole 147 extending between the gas expansion chamber and an exterior surface of the expansion body 129 for allowing release of at least a portion of combustion gas within the gas expansion chamber dependent upon a relative longitudinal position of the piston 130 within the expansion body passage 138. It is disclosed herein that the portion of the expansion body passage 138 configured for having the piston 130 slideable engaged therein can be referred to as a piston bore.

The connecting link 122 is configured for being engaged between the operating rod 104 and the piston 130. The connecting link 122 includes a stub extension 145 (i.e., piston engaging portion) that is configured for being engaged with a stub extension receiving recess 146 (i.e., mating portion) of the piston 130 and includes a rounded seat 149 (i.e., an operating rod engagement portion) that is configured for being engaged with a rounded engagement head 148 (i.e., a mating portion) at the first end portion 114 of the operating rod 104. The mating portions of the connecting link 122 and the operating rod 104 jointly provide a pivot interface therebetween that mitigates axial misalignment between the gas expansion device 120 and the operating rod 104. As shown in FIGS. 1 and 3, the rounded seat and a rounded head are respective examples of the operating rod engagement portion of the connecting link 122 and the mating engagement portion at the first end portion 114 of the operating rod 104.

The operating rod return spring 106 and the operating rod receiver bushing 108 are each configured for having the operating rod 104 pass through respective central passages thereof. A helically wound compression spring is an example of the operating rod return spring 106. In use, the operating rod return spring 106 is positioned between the rounded engagement head 148 of the operating rod 104 and a stationary structure of the firearm (e.g., the barrel nut). The operating rod return spring 106 serves to forcibly bias the operating rod 104 against the connecting link 122, thereby causing the connecting link 122 to forcibly bias the gas expansion device 120 to a prescribed at-rest orientation (e.g., the second end portion 144 of the piston 130 bearing against a mating end face of the expansion body 129) in the counter-recoil direction. The operating rod receiver bushing 108 is mounted within a mating bore of the as-manufactured OEM receiver body and serves the purpose of maintaining relative radial position between the operating rod 104 and the as-manufactured OEM receiver body.

It is disclosed herein that the gas expansion device interface portion 126 of the gas spigot 118 is configured for being engaged with an end portion of the gas expansion device 120 in a manner whereby the gas spigot passage 128 is communicatively coupled to the gas expansion chamber of the gas expansion device 120. As shown, the end portion of the gas expansion device 120 that is configured for engagement with the gas expansion device interface portion 126 includes an end portion of the expansion body 129 and the connecting link 122 is configured for engagement with an end portion of the piston 130. Alternatively, the end portion of the gas expansion device 120 that is configured for engagement with the gas expansion device interface portion 126 includes an end portion of the piston and the connecting link 122 is configured for engagement with an end portion of the gas expansion body 129. The gas expansion body 129 and the connecting link are jointly configured for allowing the connecting link 122 to be engaged with the gas expansion body 129 in a similar fashion as with the piston 130. For facilitating such an alternate implementation, the piston 130 includes a gas routing passage extending therethrough for allowing combustion gases to be routed from the gas spigot through the piston 130 into the gas expansion chamber. Accordingly, the present invention is not unnecessarily limited to a particular orientation of the gas expansion device 120 with respect to the gas expansion device interface portion 126.

The connecting link serves the primary purpose of allowing efficient replacement of the sliding component of the gas expansion device 120. As disclosed above, as shown, the piston 130 is the sliding component of the gas expansion device 120 and, in other embodiments, the gas expansion body 129 is the sliding component of the gas expansion device 120. In either case, the sliding component is a replaceable wear item. To facilitate replacement of such a wear item, an exterior surface of the connecting link 122 can be textured (e.g., knurled) to provide a hand-gripping surface that is resistant to hand slippage. Accordingly, to facilitate replacement of the sliding component of the gas expansion device 120 with the kit 100 installed in the firearm, a force can be manually applied on the connecting link 122 through the hand gripping surface for the purpose of displacing the operating rod and, thus, the operating rod driven bolt carrier 110 in the recoil direction. Through such displacement of the connecting link 122 and because the connecting link 122 is readily disengagable from the sliding component, sufficient clearance between the connecting link 122 and the sliding component can be achieved for allowing a worn sliding component to be readily replaced with a new one.

Figure 4:
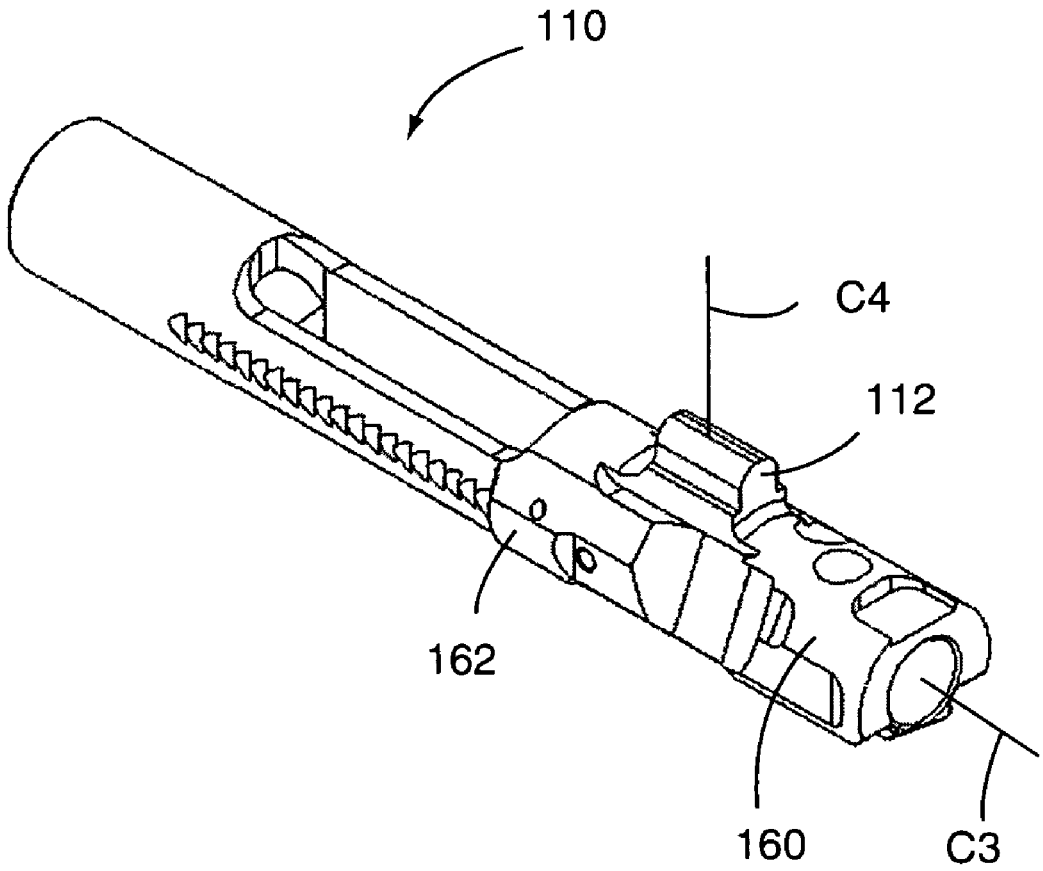
FIG. 4 is a perspective view showing an embodiment of an operating rod driven bolt carrier in accordance with the present invention.

Referring now to FIG. 4, the operating rod engaging lug 112 is radially offset from a central bore axis C3 of the operating rod driven bolt carrier 110, as is the gas lug of a corresponding gas-driven bolt carrier. Accordingly, exertion of the bolt carrier driving force on the operating rod engaging lug 112 imparts an overturning (i.e., tilting) moment on the operating rod driven bolt carrier 110. This overturning moment can be visualized as the operating rod driven bolt carrier 110 shown in FIG. 4 wanting to tilt counter-clockwise about a rotational axis extending perpendicularly out of the view. For mitigating such an overturning moment, the operating rod driven bolt carrier 110 includes forward bearing surface pads 160 (i.e., one on either side of the operating rod driven bolt carrier 110 with respect to a centerline radial axis C4) and rearward bearing surface pads 162 (i.e., one on either side of the operating rod driven bolt carrier 110 with respect to a centerline radial axis C4). The operating rod engaging lug 112 is located between the forward bearing surface pads 160 and the rearward bearing surface pads 162. The forward bearing surface pads 160 are offset toward the operating rod engaging lug 112 with respect to the central bore axis C3 of the operating rod driven bolt carrier 110 and the rearward bearing surface pads 162 are offset away from the operating rod engaging lug 112 with respect to the central bore axis C3 of the operating rod driven bolt carrier 110. As depicted, a majority of a bearing surface area of each one of the forward bearing surface pads 160 can be on an upper half of the bolt carrier 110 with respect to the central bore axis C3 and a majority of a bearing surface area of each one of the rearward bearing surface pads 162 can be on an lower half of the bolt carrier 110 with respect to the central bore axis C3. Accordingly, the bearing surface pads 160, 162 are configured in a manner to engage mating surfaces of the bolt carrier bore of the as-manufactured OEM receiver body for applying reactionary forces to counteract the overturning moment.

Advantageously, unlike conventional bolt carriers in M16-type weapons and others that use narrow bearing surface features (i.e., rib-like), the bearing surface pads 160, 162 have an aspect ratio (i.e., width-to-length ratio) that better distribute loads associated with the overturning moment. In one embodiment, the width-to-length ratio of each one of the bearing surface pads 160, 162 is at least about 0.5. In view of the overturning moment, the narrow bearing surface features of conventional bolt carriers have a tendency to exert a high stress on the mating surfaces of the as-manufactured OEM receiver body thereby increasing wear and adversely sliding performance of such conventional bolt carriers. To the contrary, the bearing surface pads in accordance with the present invention better distribute loads associated with the overturning moment, thereby improving wear characteristics and sliding performance with respect to conventional bolt carriers. Together with improved bolt carrier actuation performance derived from conversion to an operating rod driven bolt carrier in accordance with the present invention, the bearing surface pads in accordance with the present invention serve to, among other things, resist unacceptable receiver wear common to the prior art gas-piston systems for M16-type weapons, to reduce a weapon's cyclic rate of fire for longer component life of the moving parts and to provide a robust system that will endure higher rates of firing than the prior art.

Figure 5:
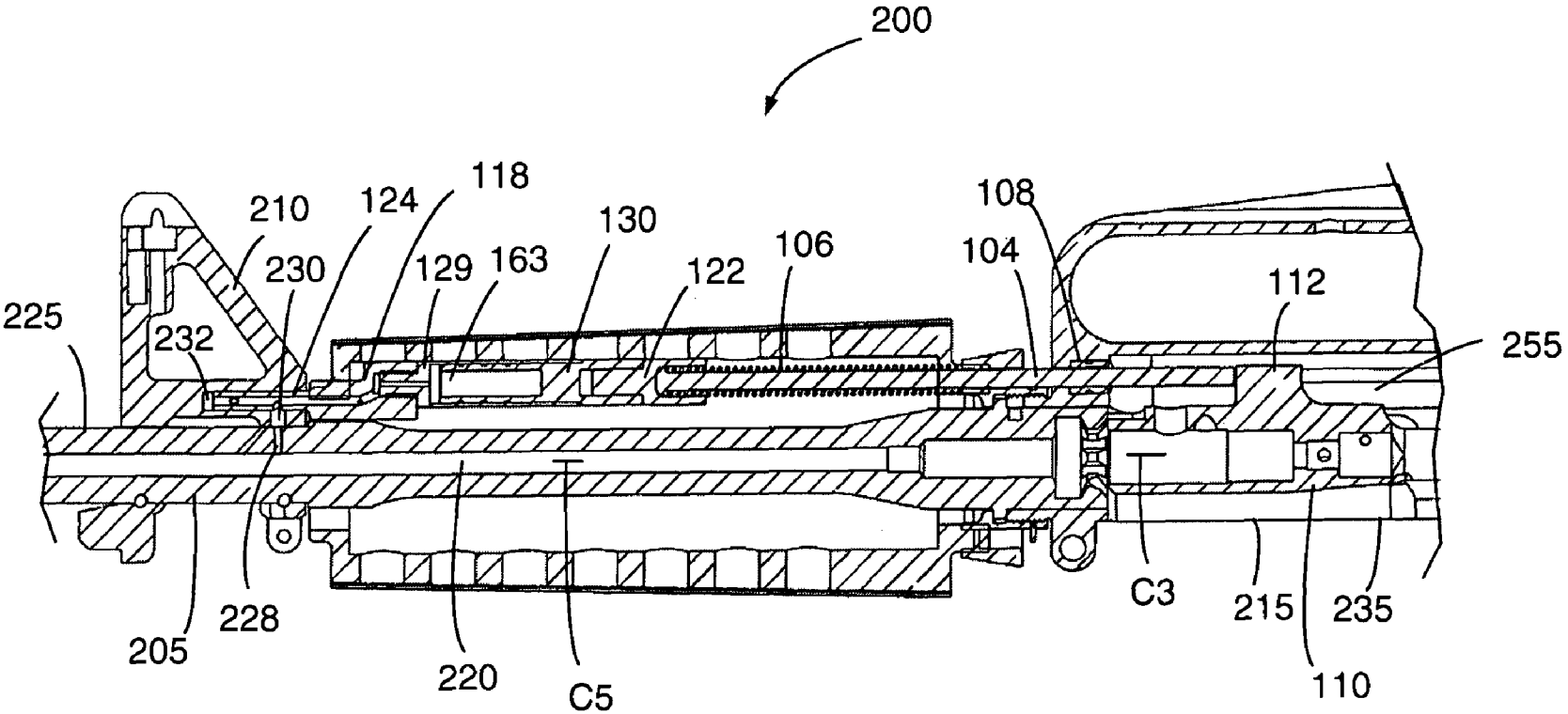
FIG. 5 is a fragmentary cross-sectional view showing an embodiment of a firearm having the kit of FIG. 1 installed therein.
Figure 6:
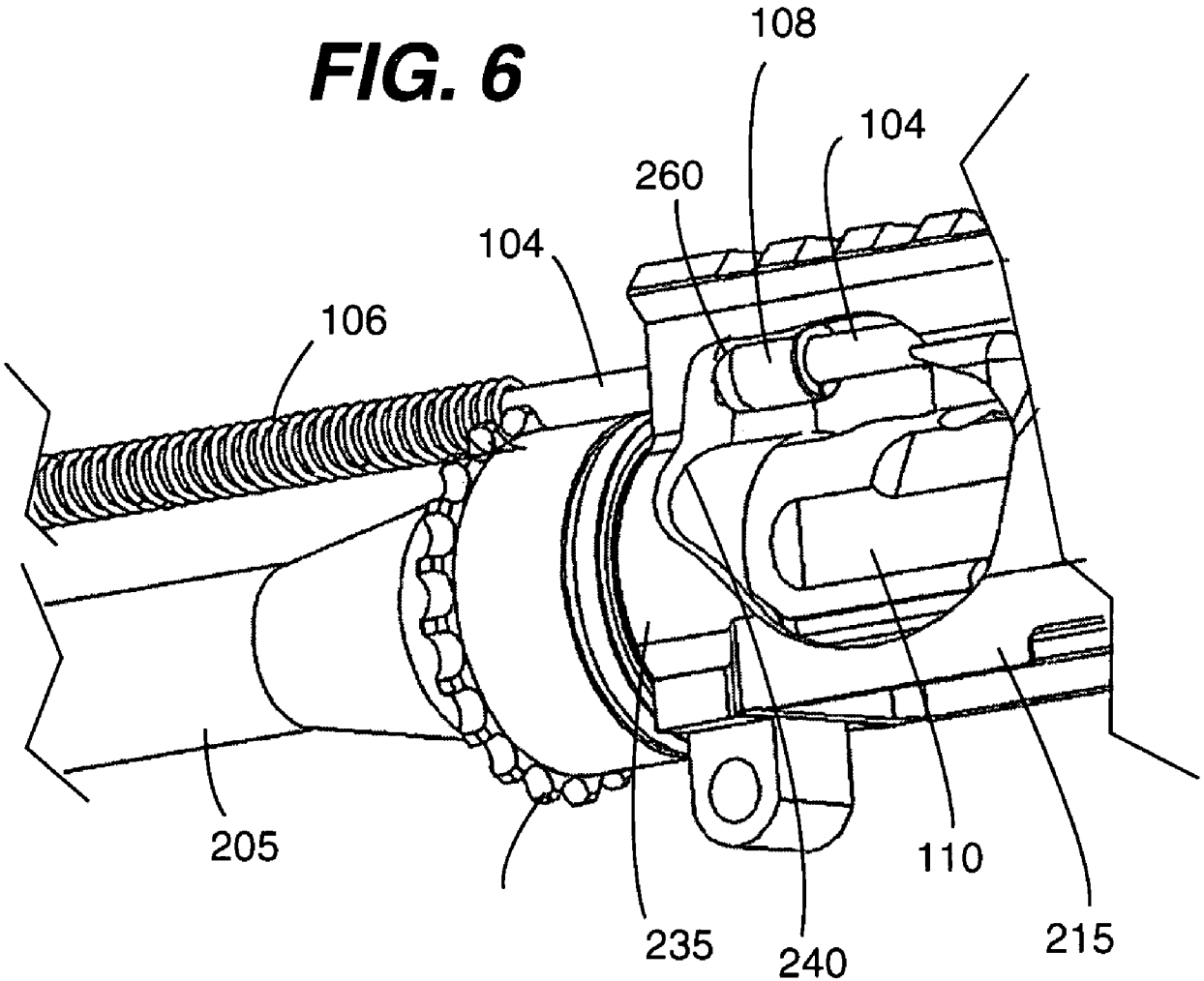
FIG. 6 is a fragmentary cut-away view of the firearm of FIG. 5 in a partially disassembled state.

Referring now to FIGS. 5 and 6, an M16-type weapon (i.e., firearm 200), which is configured by its original manufacturer to have a gas-driven bolt carrier, is shown having the kit 100 of FIGS. 1-4 installed therein. The firearm 200 includes a barrel 205, a gas block 210 and a receiver assembly 215. In accordance with the present invention, the gas block 210 is an as-manufactured OEM gas block. The barrel 205 has a bore 220 extending between opposing end portions thereof. The gas block 210, which may be integral with a sight block, is coupled to a first end portion 225 of the barrel 205 with a gas flow passage 228 of the barrel 205 aligned with a gas inlet passage 230 of the gas block 210. The gas inlet passage 230 extends between the barrel bore 220 and a gas routing passage 232 of the gas block 210. In accordance with the present invention, the gas flow passage 232 is in an OEM as-manufactured configuration (i.e., is unmodified). The gas block interface portion 124 of the gas spigot 118 is engaged within the gas routing passage 232 of the gas block 210. In this manner, combustion gas from the barrel bore 220 is routed from within the barrel bore 220 through the gas flow passage 230 of the gas block 210 into the gas spigot passage 128 and then into the gas expansion chamber, which is shown as gas expansion chamber 163 in FIG. 5. Preferably, but not necessarily, a load carrying device (e.g., a compression spring, shims, etc) are inserted into the gas routing passage 232 of the gas block 210 prior to inserting the gas block interface portion 124 into the gas routing passage 232 and installing a retention device into the retention device passage 134 and mating retention passage of the gas block 210. The load carrying member (not shown) is engaged axially between the gas block 210 and the gas spigot 118 for the purpose of channeling essentially all axial force exerted on the gas expansion assembly into the gas block 210. Impact loads that would otherwise be exerted on the retention device are exerted on the gas block 210 through the load carrying member. Accordingly, the as-manufactured OEM gas block flow passage 232 and gas expansion assembly in accordance with the present invention jointly facilitate converting combustion gas from the barrel bore 220 into a force applied on the operating rod 104, which is exerted on the operating rod engaging lug 112 for actuating the operating rod driven bolt carrier 110.

The operating rod bushing 108 is engaged within a bolt carrier gas lug bore 260 of the as-manufactured OEM receiver body 235. The receiver assembly 215 including an as-manufactured OEM receiver body 235 and the operating rod driven bolt carrier 110 operably engaged within a bolt carrier bore 240 of the as-manufactured OEM receiver body 235. The as-manufactured OEM receiver body 235 is coupled to a second end portion 245 of the barrel 205 such that a central bore axis C3 of the operating rod driven bolt carrier 110 extends substantially coincidental with a centerline axis C5 of the barrel bore 220. The operating rod engaging lug 112 of the operating rod driven bolt carrier 110 is located in a gas tube lug receiving portion 255 of the as-manufactured OEM receiver body 235.

It is disclosed herein that a kit in accordance with the present invention may include a modified hand guard set or a single modified hand guard. In some cases, modification must be made to an internal portion of the hand guard set or one of the hand guards to provide suitable clearance for one of more components of a kit in accordance with the present invention. For example, in some cases, all or a portion of a heat shield assembly must be removed to provide adequate clearance for one or more components of a kit in accordance with the present invention. Examples of hand guard sets or hand guards that may be included in a kit in accordance with the present invention include, but are not limited to, that disclosed in U.S. Pat. No. 4,663,875; U.S. Pat. No. 4,536,982; U.S. Pat. No. 5,826,363; U.S. Pat. No. 5,590,484; U.S. Pat. No. 6,499,245; U.S. Pat. No. 6,490,822; U.S. Pat. No. 6,895,708; and US published patent application 20060236583A1.

In some embodiments of the present invention, a clamp is provided that interfaces with both a barrel of a firearm and the gas expansion device. The clamp is designed to be adjusted to accommodate a range of barrel diameters and is designed to provide stability for the gas expansion device and gas spigot to resist deflection or bending forces. In some embodiments of the present invention, an auxiliary gas-block is clamped to the barrel diameter between the principal gas-block, which receives gasses from the barrel upon the firing of a cartridge, and the receiver body carrying the bolt carrier. A gas tube connects the principal gas-block to the auxiliary gas-block for communicating gasses necessary to automatically cycle the action. The auxiliary gas-block is configured for receiving the gas tube on one end and having engaged therewith a gas expansion assembly or gas expansion device in accordance with the present invention. An operating rod and, optionally, connecting link are implemented as described above. The auxiliary gas-block accommodates offset difference between the hole in a gas-tube receiving hole of the principle gas-block and an original gas-tube receiving hole in the upper receiver body.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bolt carrier, comprising:

a front end portion having an opening therein configured for having a bolt moveably mounted therein;

a rear end portion;

an operating rod engaging lug on an exterior surface of the bolt carrier at a location between the front and rear end portion thereof, wherein an operating rod engaging surface of the operating rod engaging lug faces toward the front end portion and away from the rear end portion;

a set of forward bearing surface pads located forward of the operating rod engaging surface of the operating rod engaging lug, wherein a first one of said forward bearing surface pads is located on a first side of the bolt carrier with respect to a centerline radial axis thereof and a second one of said forward bearing surface pads is located on a second side of the bolt carrier with respect to the centerline radial axis thereof and wherein each one of said forward bearing surface pads extends above a longitudinal central bore axis of the bolt carrier; and a set of rearward bearing surface pads located rearward of the operating rod engaging lug, wherein a first one of said rearward bearing surface pads is located on the first side of the bolt carrier and a second one of said rearward bearing surface pads is located on the second side of the bolt carrier and wherein each one of said rearward bearing surface pads extends below the longitudinal central bore axis of the bolt carrier.

2. The bolt carrier of claim 1 wherein the operating rod engaging lug is located between said forward bearing surface pads and said rearward bearing surface pads.

3. The bolt carrier of claim 1 wherein each one of said bearing surface pads has a width-to-length ratio of at least about 0.5.

4. The bolt carrier of claim 1 wherein:

each one of said forward bearing surface pads extends from a front end face of the bolt carrier at the first end portion thereof toward the operating rod engaging lug, and each one of said rearward bearing surface pads extends rearward of the operating rod engaging lug.

5. The bolt carrier of claim 1 wherein:

each one of said forward bearing surface pads extend from a front end face of the bolt carrier at the first end portion thereof toward an operating rod engaging surface of the operating rod engaging lug;

a majority of a bearing surface area of each one of said forward bearing surface pads is on an upper half of the bolt carrier with respect to the longitudinal central bore axis thereof; and a majority of a bearing surface area of each one of said rearward bearing surface pads is on an lower half of the bolt carrier with respect to the longitudinal central bore axis thereof.

6. The bolt carrier of claim 5 wherein each one of said bearing surface pads has a width-to-length ratio of at least about 0.5.

7. The bolt carrier of claim 1 wherein:

each one of said forward bearing surface pads each extend from a front end face of the bolt carrier at the first end portion thereof toward an operating rod engaging surface of the operating rod engaging lug;

a majority of a bearing surface area of each one of said forward bearing surface pads is on an upper half of the bolt carrier with respect to the longitudinal central bore axis thereof; and a majority of a bearing surface area of each one of said rearward bearing surface pads is on an lower half of the bolt carrier with respect to the longitudinal central bore axis thereof;

the operating rod engaging lug is located between said forward bearing surface pads and said rearward bearing surface pads.

8. The bolt carrier of claim 1 wherein:

each one of said bearing surface pads has a width-to-length ratio of at least about 0.5; and the operating rod engaging lug is located between said forward bearing surface pads and said rearward bearing surface pad.

* * * * *